US012575665B2

(12) United States Patent
Lowet et al.

(10) Patent No.: US 12,575,665 B2
(45) Date of Patent: Mar. 17, 2026

(54) SYSTEMS AND METHODS FOR DETERMINING LOCATION AND ORIENTATION OF AN ORAL CARE DEVICE

(71) Applicant: KONINKLIJKE PHILIPS N.V., Eindhoven (NL)

(72) Inventors: Dietwig Jos Clement Lowet, Tongeren (BE); Jan Martijn Krans, Den Bosch (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 354 days.

(21) Appl. No.: 18/033,545

(22) PCT Filed: Oct. 26, 2021

(86) PCT No.: PCT/EP2021/079599
§ 371 (c)(1),
(2) Date: Apr. 24, 2023

(87) PCT Pub. No.: WO2022/090184
PCT Pub. Date: May 5, 2022

(65) Prior Publication Data

US 2023/0397713 A1 Dec. 14, 2023

Related U.S. Application Data

(60) Provisional application No. 63/106,520, filed on Oct. 28, 2020.

(51) Int. Cl.
*A46B 15/00* (2006.01)

(52) U.S. Cl.
CPC ..... *A46B 15/0016* (2013.01); *A46B 15/0012* (2013.01); *A46B 2200/1066* (2013.01)

(58) Field of Classification Search
CPC ..... A46B 15/0016; A46B 15/0012; A46B 2200/1066
(Continued)

(56) References Cited

U.S. PATENT DOCUMENTS 10,064,711 B1 9/2018 Richter et al.
2010/0323337 A1 12/2010 Ikkink et al.
(Continued)

FOREIGN PATENT DOCUMENTS

CN 106333480 A 1/2017
CN 206238734 U 6/2017

OTHER PUBLICATIONS

International Search Report and Written Opinion Dated Feb. 23, 2022 for International Application No. PCT/EP2021/079599 Filed Oct. 26, 2021.

*Primary Examiner* — Sujoy K Kundu

(57) ABSTRACT

Systems and methods of determining a location of a brush head within a user's mouth during an oral care routine are provided. Example systems and methods involve: determining, during a learning phase, anchor points defining a quadrant of the mouth of the user and a pressure pattern based on pressure sensor data from a pressure sensor; wherein the pressure pattern includes at least two peaks corresponding to the first or second anchor points or a tooth; generating, during the oral care routine, a pressure signal including at least one peak, a longitudinal component indicating a direction the brush head is moving, and a transverse component indicating an amount of pressure being exerted; analyzing the pressure signal based on the anchor points and the pressure pattern determined during the learning phase; and estimating one or more locations of the brush head within the defined quadrant during the oral care routine.

14 Claims, 8 Drawing Sheets

(58) Field of Classification Search
USPC ..... 702/189
See application file for complete search history.

(56) References Cited

U.S. PATENT DOCUMENTS

| | | | | |
|---|---|---|---|---|
| 2012/0266397 | A1* | 10/2012 | Iwahori ..... | A46B 15/0014 15/22.1 |
| 2014/0065588 | A1 | 3/2014 | Jocobson et al. | |
| 2020/0022488 | A1 | 1/2020 | Den Hamer et al. | |
| 2020/0179089 | A1 | 6/2020 | Serval et al. | |
| 2020/0329857 | A1 | 10/2020 | Deane et al. | |

* cited by examiner

SYSTEMS AND METHODS FOR DETERMINING LOCATION AND ORIENTATION OF AN ORAL CARE DEVICE

This application is the U.S. National Phase application under 35 U.S.C. § 371 of International Application No. PCT/EP2021/079599, filed on Oct. 26, 2021, which claims the benefit of U.S. Application Ser. No. 63/106,520, filed Oct. 28, 2020. These applications are hereby incorporated by reference herein.

FIELD OF THE INVENTION

The present disclosure relates generally to systems and methods for determining location and orientation of an oral care device within the user's head during an oral care routine.

BACKGROUND

Tracking the location of an oral care device within the user's head enables effective feedback to a user with respect to the user's oral hygiene practices. For example, if the location of a brush head is tracked within the user's mouth, portions of a group of teeth, a specific tooth, or gum section not yet cleaned may be identified so that the user can focus on those areas. Further, appropriate feedback regarding a user's technique, e.g., brushing too hard, too soft, or not long enough on a particular section of the mouth, can be provided based on tracking the location of the oral care device within the mouth during use.

Various conventional forms of tracking the location of an oral care device within a user's mouth are known. For example, inertial motion sensors such as accelerometers, gyroscopes, and magnetic sensors positioned in the handle of the device are utilized to measure the absolute movement of an oral care device with respect to gravity or the direction of force, but are not capable of detecting the relative movement of the oral care device relative to the head of the user. As long as the head of the user remains fixed, it is sufficient to determine the absolute movement of the oral care device since that would be the same as the relative movement. However, if the user is moving the oral care device and his/her head at the same time, or when the user repositions his/her head during an oral care routine, it is difficult, if not impossible, to determine from an accelerometer in the oral care device alone that the brush has actually not moved relative to the head or to the teeth. These conventional forms of tracking, therefore, are unable to differentiate between head movements and oral care device movements. These limitations of the conventional technology can lead to inaccurate tracking and poor feedback.

Accordingly, there is a need in the art for systems and methods for improved localization of an oral care device during use, including distinguishing between head movements and movements of the oral care device.

SUMMARY OF THE INVENTION

The present disclosure is directed to inventive systems and methods for determining the location and orientation of an oral care device within the user's head during an oral care routine even when the user is moving. Applied to a system configured to localize an oral care device within the mouth, the inventive methods and systems enable greater precision of localization and tracking and thus enable an improved evaluation of a user's brushing technique. Various embodiments and implementations herein are directed to an oral care device including a pressure sensor that can be configured to deduce the location and orientation of the brush head of the oral care device within the user's mouth during use of the oral care device. The pressure sensor can be wired or wirelessly connected to a controller comprising a processor and a non-transitory storage medium for storing program code, which can be programmed to detect when the brush head of the device is located within a designated quadrant within the oral cavity, estimate the orientation of the device, and determine at which one or more teeth within the designated quadrant the brush head is contacting. According to embodiments, the sensor data provides information about which quadrant the device is located, the orientation of the device, how long the device remains at a location, to which direction the device is moving within the mouth, such as backward or forward, the position of the device within the quadrant, and/or the distance the device has travelled within the quadrant.

Generally, in one aspect, a method for determining a location of a brush head of an oral care device within a user's mouth during an oral care routine is provided. The method includes: determining, during a learning phase, first and second anchor points defining a quadrant of the mouth of the user and a pressure pattern for the defined quadrant based on pressure sensor data from a pressure sensor within the oral care device, wherein the pressure pattern includes at least two peaks in the pressure sensor data, the at least two peaks corresponding to the first or second anchor points or a tooth within the defined quadrant of the mouth of the user; generating, after the learning phase and in response to interaction of the brush head with a plurality of dental surfaces in the defined quadrant during the oral care routine, a pressure signal from the pressure sensor, wherein the pressure signal includes at least one peak, a longitudinal component indicating a direction the brush head is moving, and a transverse component indicating an amount of pressure exerted on the pressure sensor by the plurality of dental surfaces; analyzing, by a controller during the oral care routine, the pressure signal based on the anchor points and the pressure pattern determined during the learning phase; and estimating, by the controller during the oral care routine, one or more locations of the brush head within the defined quadrant based at least in part on the at least one peak and the longitudinal and transverse components of the pressure signal.

According to an embodiment, the step of estimating the location of the brush head includes: detecting the brush head is located within the defined quadrant during the oral care routine; counting, by the controller, at least one peak in the pressure signal; and outputting, by the controller, a first estimated location of the brush head in real time based on the at least one peak counted in the pressure signal.

According to an embodiment, the method includes: detecting the brush head is located at the first or second anchor point of the defined quadrant during the oral care routine; and outputting, by the controller, a second estimated location of the brush head in real time, wherein the second estimated location is the first or second anchor point of the defined quadrant.

According to an embodiment, the method includes: determining that the first real time estimated location is not equal to the second real time estimated location; and modifying, by the controller, the first real time estimated location based at least in part on the second estimated location.

According to an embodiment, the method includes: obtaining motion sensor data from an inertial motion sensor of the oral care device and additional motion sensor data from an additional sensor configured to be worn on the user's head as a wearable device; analyzing the motion sensor data and the additional motion sensor data; and distinguishing, by the controller, movement of the oral care device relative to movement of the user based at least in part on the motion sensor data and the additional motion sensor data.

According to an embodiment, the method includes providing feedback to the user regarding the determined movement of the oral care device with respect to movement of the user via the wearable device.

According to an embodiment, the additional motion sensor data includes an accelerometer signal that indicates vibrations resulting from the oral care device contacting the mouth of the user.

According to an embodiment, the wearable device includes a microphone and the step of distinguishing movement of the oral device relative to movement of the user includes determining a relative position of the oral care device relative to the microphone.

According to an embodiment, the wearable device includes a camera and the additional motion sensor data includes video data from the camera and the step of distinguishing movement of the oral care device relative to movement of the user includes estimating the movement of the user's head based on analysis of the video data.

Generally, in another aspect, an oral care device is provided. The oral care device includes: a body portion and a brush head; a pressure sensor configured to generate pressure sensor data and a pressure signal; and controller in communication with the pressure sensor; wherein during a learning phase, the controller is configured to: determine first and second anchor points defining a quadrant of the mouth of the user and a pressure pattern for the defined quadrant based on the pressure sensor data from the pressure sensor, wherein the pressure pattern includes at least two peaks, the at least two peaks corresponding to the first or second anchor points or a tooth within the defined quadrant; wherein after the learning phase and during an oral care routine, the controller is configured to: analyze the pressure signal from the pressure sensor based on the first and second anchor points and the pressure pattern determined during the learning phase, the pressure signal comprising at least one peak, a longitudinal component indicating a direction the brush head is moving, and a transverse component indicating an amount of pressure exerted on the pressure sensor; and estimate one or more locations of the brush head within the defined quadrant based at least in part on the at least one peak and the longitudinal and transverse components of the pressure signal.

According to an embodiment, the oral care device includes an inertial motion sensor in communication with the controller, wherein the inertial motion sensor is configured to provide motion sensor data; and an additional motion sensor configured to be worn on the head of the user as a wearable device, wherein the additional motion sensor is in communication with the controller and configured to provide additional motion sensor data; wherein the controller is configured to analyze the motion sensor data and the additional motion sensor data and distinguish movement of the oral care device relative to movement of the user based at least in part on the motion sensor data and the additional motion sensor data.

According to an embodiment, the additional motion sensor data includes an accelerometer signal that indicates vibrations resulting from the oral care device contacting the mouth of the user.

According to an embodiment, the wearable device includes a microphone and the controller is configured to determine a position of the oral care device relative to the microphone.

According to an embodiment, the wearable device includes a camera and the additional motion sensor data includes video data from the camera and the controller is configured to estimate movement of the head of the user based on an analysis of the video data.

Generally, in a further aspect, a method for determining a location of a brush head of an oral care device within a user's mouth during an oral care routine is provided. The method includes: providing an oral care device comprising a brush head and a motion sensor; receiving, at a controller of the oral care device or a user device during the oral care routine, sensor data from the motion sensor and an additional sensor associated with a wearable device configured to be worn on a head of the user; analyzing, by the controller during the oral care routine, the sensor data to determine if the head of the user is moving relative to the oral care device; and generating, by the controller during the oral care routine, location information of the oral care device within the head of the user based on the sensor data.

As used herein for purposes of the present disclosure, the term "controller" is used generally to describe various apparatus relating to the operation of an oral care device, system, or method. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present disclosure discussed herein. The terms "program" or "computer program" are used herein in a generic sense to refer to any type of computer code (e.g., software or microcode) that can be employed to program one or more processors or controllers.

The term "user interface" as used herein refers to an interface between a human user or operator and one or more devices that enables communication between the user and the device(s). Examples of user interfaces that may be employed in various implementations of the present disclosure include, but are not limited to, switches, potentiometers, buttons, dials, sliders, track balls, display screens, various types of graphical user interfaces (GUIs), touch screens, microphones and other types of sensors that may receive some form of human-generated stimulus and generate a signal in response thereto.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

These and other aspects of the invention will be apparent from and elucidated with reference to the embodiment(s) described hereinafter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION OF EMBODIMENTS

The present disclosure describes various embodiments of methods, systems, and oral care devices for characterizing the location of the oral care device within the user's mouth during an oral care routine (e.g., a brushing session) even if the user is moving during the routine. The embodiments described herein include an oral care device, one or more pressure sensors, and one or more inertial motion sensors to determine in which quadrant the device is located during brushing and the position of the device within the quadrant. More generally, Applicant has recognized and appreciated that it would be beneficial to provide methods and systems that distinguish between movement of the user's head and movement of the oral care device during an oral care routine using inertial motion sensors and an additional pressure sensor, and utilize that information to track the oral care device during the oral care routine to provide brushing feedback. Accordingly, the methods and systems described or otherwise envisioned herein estimate the location of a brush head of the oral care device during an oral care routine using sensors without relying solely on accelerometer and/or gyroscope data that only indicates absolute movement of the oral care device.

The embodiments and implementations disclosed or otherwise envisioned herein can be utilized with any oral care device. Examples of suitable oral care devices include a toothbrush such as a Philips Sonicare® toothbrush (manufactured by Koninklijke Philips, N.V.), a flossing device such as a Philips AirFloss®, an oral irrigator, a tongue cleaner, or other oral care device. However, the disclosure is not limited to these enumerated devices, and thus the disclosure and embodiments disclosed herein can encompass any oral care device.

Figure 1:
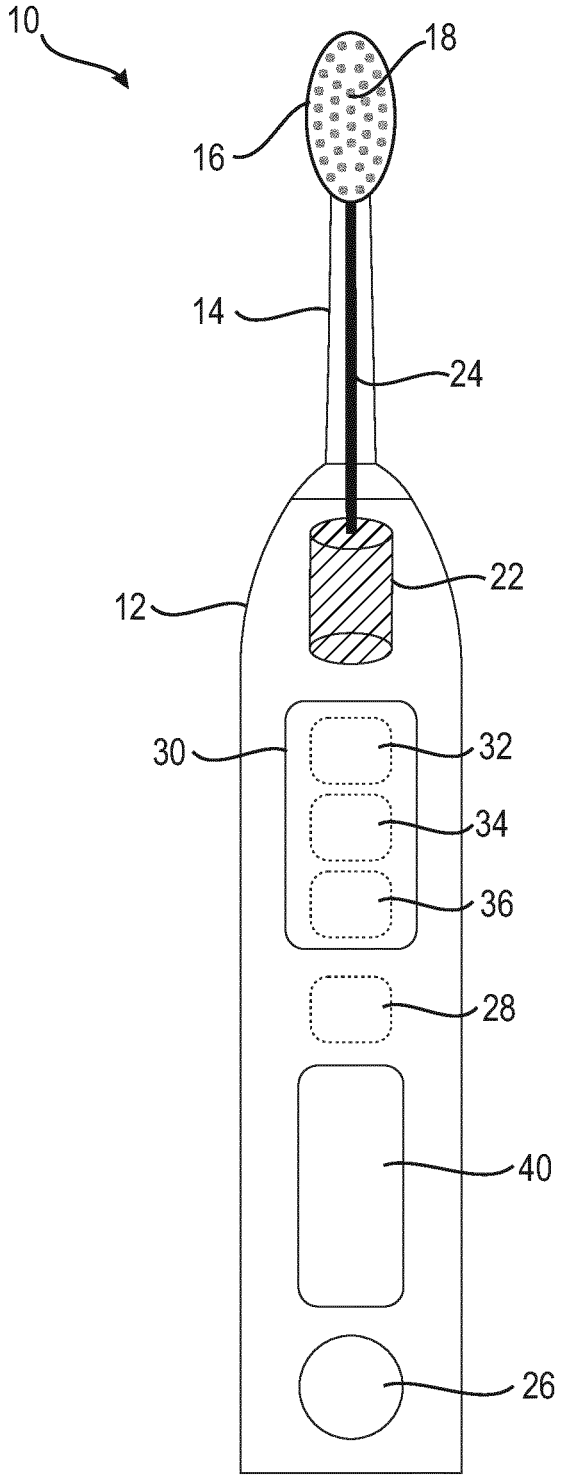
FIG. 1 is a schematic representation of an oral care device, in accordance with aspects of the present disclosure.

Referring to FIG. 1, in one embodiment, an oral care device 10 is provided that includes a body portion 12 and a brush head member 14. Brush head member 14 includes at its end remote from the body portion 12 a brush head 16 having a plurality of bristles 18. The body portion 12 typically includes a housing, at least a portion of which is hollow, to contain components of the oral care device. Brush head member 14 is mounted so as to be able to move relative to the body portion 12. The movement can be any of a variety of different movements, including vibrations or rotation, among others.

The body portion 12 typically contains a drivetrain assembly with a motor 22 for generating movement, and a transmission component or drivetrain shaft 24, for transmitting the generated movements to brush head member 14. For example, the drivetrain includes a motor or electromagnet(s) 22 that generates movement of a drivetrain shaft 24, which is subsequently transmitted to the brush head member 14. The drivetrain can include components such as a power supply, an oscillator, and one or more electromagnets, among other components. In this embodiment the power supply includes one or more rechargeable batteries, not shown, which can, for example, be electrically charged in a charging holder in which oral care device 10 is placed when not in use. According to one embodiment, brush head member 14 is mounted to the drive train shaft 24 so as to be able to vibrate relative to body portion 12. The brush head member 14 can be fixedly mounted onto drive train shaft 24, or it may alternatively be detachably mounted so that brush head member 14 can be replaced with a different brush head member for different operating features, or when the bristles or another component of the brush head are worn out and require replacement.

The body portion 12 is further provided with a user input 26 to activate and de-activate the drivetrain. The user input 26 allows a user to operate the oral care device 10, for example, to turn the device on and off. The user input 26 may, for example, be a button, touch screen, or switch.

The body portion 12 of the device also includes a controller 30. Controller 30 may be formed of one or multiple modules, and is configured to operate the oral care device 10 in response to an input, such as input obtained via user input 26. Controller 30 can include, for example, a processor 32, a memory 34, which can store an operating system as well as sensor data, and a connectivity module 36. The processor 32 may take any suitable form, including but not limited to a microcontroller, multiple microcontrollers, circuitry, a single processor, or plural processors. The memory 34 can take any suitable form, including a non-volatile memory and/or RAM. The non-volatile memory may include read only memory (ROM), a hard disk drive (HDD), or a solid state drive (SSD). The memory can store, among other things, an operating system. The RAM is used by the processor for the temporary storage of data. According to an embodiment, an operating system may contain code which, when executed by controller 30, controls operation of the hardware components of oral care device 10. According to an embodiment, connectivity module 36 transmits collected sensor data, and can be any module, device, or means capable of transmitting a wired or wireless signal, including but not limited to a Wi-Fi, Bluetooth, near field communication, and/or cellular module.

Connectivity module 36 of the device can be configured and/or programmed to transmit sensor data to a wireless transceiver (not shown). For example, connectivity module 36 may transmit sensor data via a Wi-Fi connection over the Internet or an Intranet to a dental professional, a database, or other location. Alternatively, connectivity module 36 may transmit sensor or feedback data via a Bluetooth or other wireless connection to a local device (e.g., a separate computing device), database, or other transceiver. For example, connectivity module 36 allows the user to transmit sensor data to a separate database to be saved for long-term storage, to transmit sensor data for further analysis, to transmit user feedback to a separate user interface, or to share data with a dental professional, among other uses. Connectivity module 36 may also be a transceiver that can receive user input information, including the above referenced standards (as should be appreciated by a person of ordinary skill in the art in conjunction with a review of this disclosure). Other communication and control signals described herein can be effectuated by a hard wire (non-wireless) connection, or by a combination of wireless and non-wireless connections.

Although in the present embodiment the oral care device 10 is an electric toothbrush, it will be understood that in an alternative embodiment the oral care device is a manual toothbrush (not shown). In such an arrangement, the manual toothbrush has electrical components, but the brush head is not mechanically actuated by an electrical component.

According to an embodiment, oral care device 10 can be programmed and/or configured to distinguish movement of a user's head from movement of the oral care device during an oral care routine. As discussed herein, the information or data analyzed or used by oral care device 10 to carry out the functions and methods described herein can be generated by the one or more sensors. The one or more sensors can be any of the sensors described or otherwise envisioned herein, and can be programmed and/or configured to obtain sensor data regarding one or more aspects of movement of the oral care device or the user's movement (e.g., head movement) during a brushing session.

The oral care device 10 further includes a user interface 40, which is configured to transmit information to or receive information from the user. In embodiments, the user interface 40 is configured to provide information to a user before, during, and/or after an oral care routine. The user interface 40 can take many different forms, but is configured to provide information to a user. For example, the information can be read, viewed, heard, felt, and/or otherwise interpreted concerning the oral care routine. According to an embodiment, the user interface 40 provides feedback to the user, such as a guided oral care routine, that includes information about where and how to clean. Accordingly, the user interface may be a display that provides information to the user, a haptic mechanism that provides haptic feedback to the user, a speaker to provide sounds or words to the user, or any of a variety of other user interface mechanisms. According to an embodiment, controller 30 of oral care device 10 receives information from the one or more sensors described herein, assesses and analyzes that information, and provides information that can be displayed to the user via the user interface 40. Although FIG. 1 shows the user interface 40 arranged within body portion 12, it should be appreciated that in embodiments user interface 40 can be arranged in brush head member 14.

Oral care device 10 includes one or more sensors 28 and 42. Sensor 28 is shown in FIG. 1 within body portion 12, but may be located anywhere within the device, including for example within brush head member 14 or brush head 16. Sensor 28 can comprise, for example, an inertial motion sensor such as an accelerometer, gyroscope, or magnetic sensor configured to generate sensor data in response to motion and communicate that data to controller 30. According to an embodiment, sensor 28 is configured to provide readings of six axes of relative motion (three axes translation and three axes rotation), using, for example, a 3-axis gyroscope and a 3-axis accelerometer. As another example, sensor 28 is configured to provide the readings of nine axes of relative motion using, for example, a 3-axis gyroscope, a 3-axis accelerometer, and a 3-axis magnetometer. According to an embodiment, sensor 28 is configured to generate information indicative of the acceleration and angular orientation of oral care device 10. The sensor may comprise two or more sensors 28 that function together as the 6-axis or a 9-axis spatial sensor system. Sensor data generated by sensor 28 is provided to controller 30. According to an embodiment, sensor 28 is integral to controller 30. Controller 30 can receive the sensor data from sensor 28 in real-time or periodically. For example, sensor 28 may send a constant stream of sensor data to controller 30 for storage and/or analysis, or may temporarily store and aggregate or process data prior to sending it to controller 30. Once received by controller 30, the sensor data can be processed by processor 32.

Figure 2:
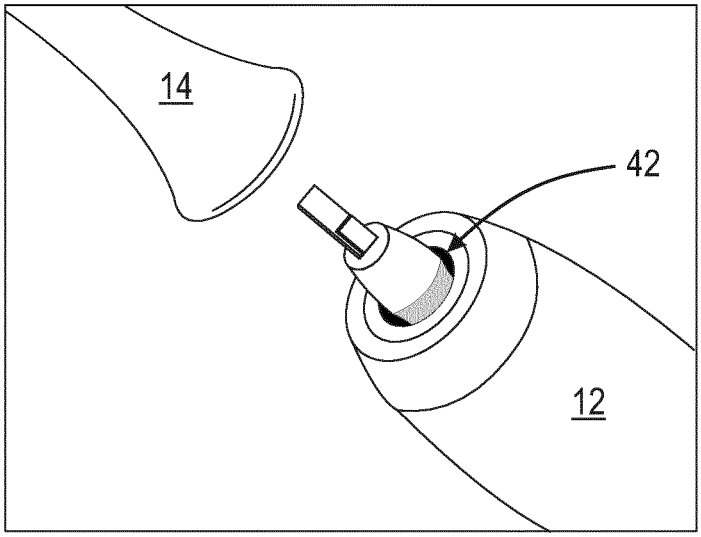
FIG. 2 is a schematic representation of a pressure sensor arranged between a brush head and a brush handle of an oral care device, in accordance with aspects of the present disclosure.

Oral care device 10 further includes pressure sensor 42. Sensor 42 is shown in FIG. 2, between the brush head member 14 and the body portion 12 but may be located anywhere within the device 10. Pressure sensor 42 is configured to sense pressure in a longitudinal direction to measure the back and forth movement of the brush in the mouth of a user. When a user pushes the brush head deeper in the mouth, this movement generates an increased pressure on the pressure sensor. When the user retracts the brush head back, this movement causes a negative pressure on the pressure sensor. Pressure sensor 42 is also configured to sense pressure in a transverse direction to measure the amount of pressure the brush experiences when moving over the teeth. Sensor data generated by sensor 42 is provided to controller 30. Pressure sensor 42 is provided as a mechanism to distinguish between user movement and brush head movement. Pressure sensor 42 is utilized either alone or in conjunction with sensors 28.

Figure 3:
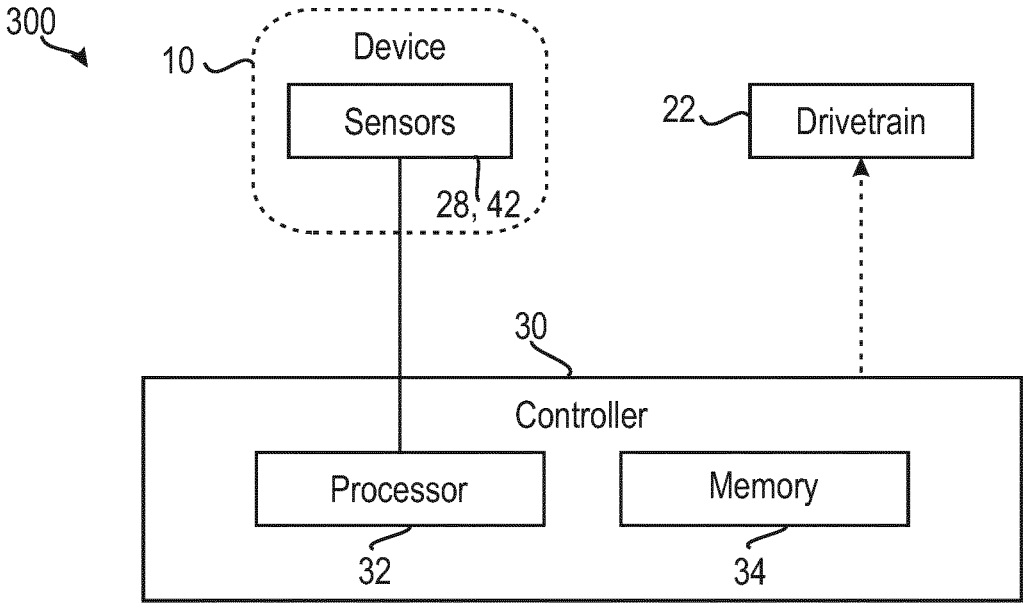
FIG. 3 is a schematic representation of an oral care system, in accordance with aspects of the present disclosure.

Referring to FIG. 3, an embodiment of an oral care system 300 is provided. According to an embodiment, oral care system 300 includes one or more sensors 28, 42 in an oral care device 10, and a controller 30 having a processor 32 and a memory 34. When utilized with electric cleaning devices, the oral care system 300 includes a drivetrain 22, the operation of which is controlled by controller 30. The one or more sensors 28, 42 in device 10 are in wired and/or wireless communication with controller 30, and the sensor data generated by the one or more sensors 28, 42 is provided to controller 30 for the various analyses described herein.

Figure 4A:
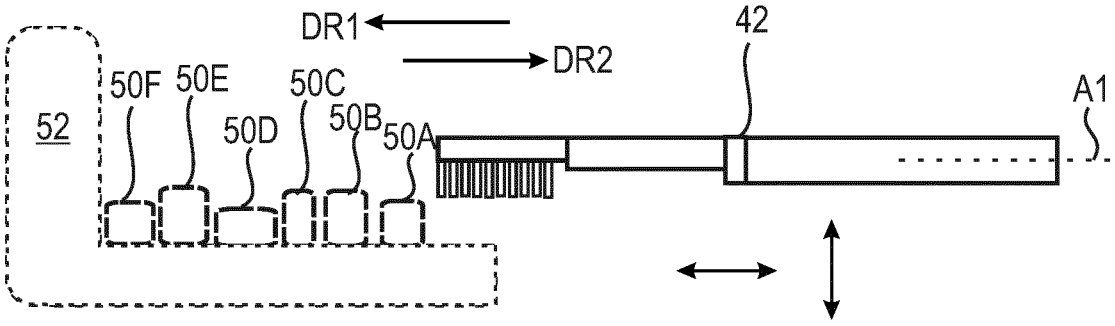
FIG. 4A is a schematic representation of an oral care device with teeth of a quadrant of a user's mouth, in accordance with aspects of the present disclosure.
Figure 4B:
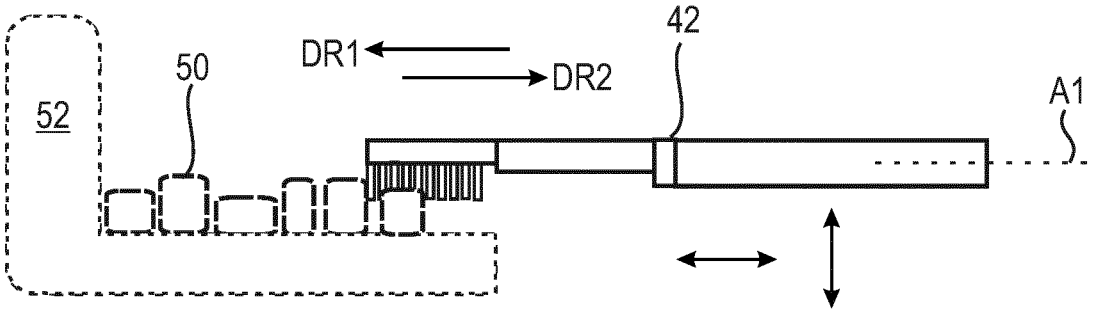
FIG. 4B is a schematic representation of the oral care device of FIG. 4A moved to a position closer to the back of the user's mouth, in accordance with aspects of the present disclosure.
Figure 4C:
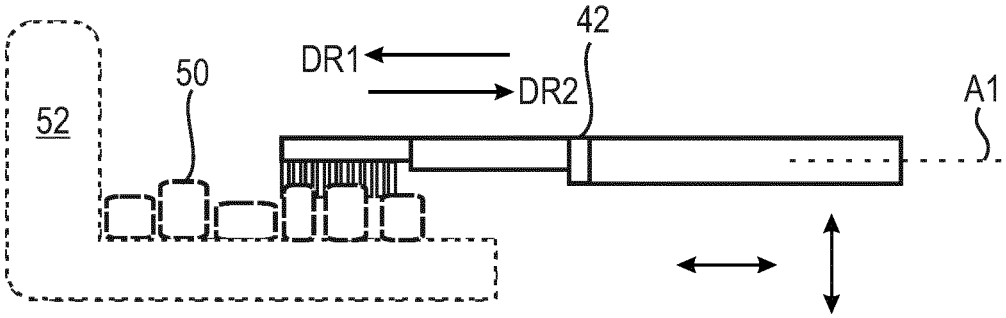
FIG. 4C is a schematic representation of the oral care device of FIG. 4A moved to another position closer to the back of the user's mouth, in accordance with aspects of the present disclosure.

As shown in FIGS. 4A, 4B, and 4C, in an embodiment brush head 16 of device 10 can interact with dental surfaces such as one or more teeth 50, gums 52, and cheek (not shown). As the user pushes the brush head in direction DR1 toward the back of the mouth, the brush head experiences a positive friction force; thus, pressure sensor 42 experiences a positive pressure. Additionally, as the brush head is pushed against the teeth in direction DR1, the pressure sensor 42 experiences a resistive force from the teeth and/or gums. Each time the brush head passes one or more teeth, the pressure sensor 42 experiences an increase in pressure. When the user is moving the brush head back and forth along the teeth, this creates a pressure pattern alongside the axis of the toothbrush A1. Additionally, when the brush head reaches the back of the user's mouth, it experiences a strong increase in pressure since the toothbrush has increasing less freedom of movement and contacts the back of the oral cavity between the teeth and cheek. Each quadrant of the user's mouth has a specific pressure pattern regardless of direction. Thus, the controller 30 can analyze the pressure patterns generated by the pressure sensor 42 to estimate where the brush head is located within a particular quadrant of the user's mouth as further described below.

Figure 5:
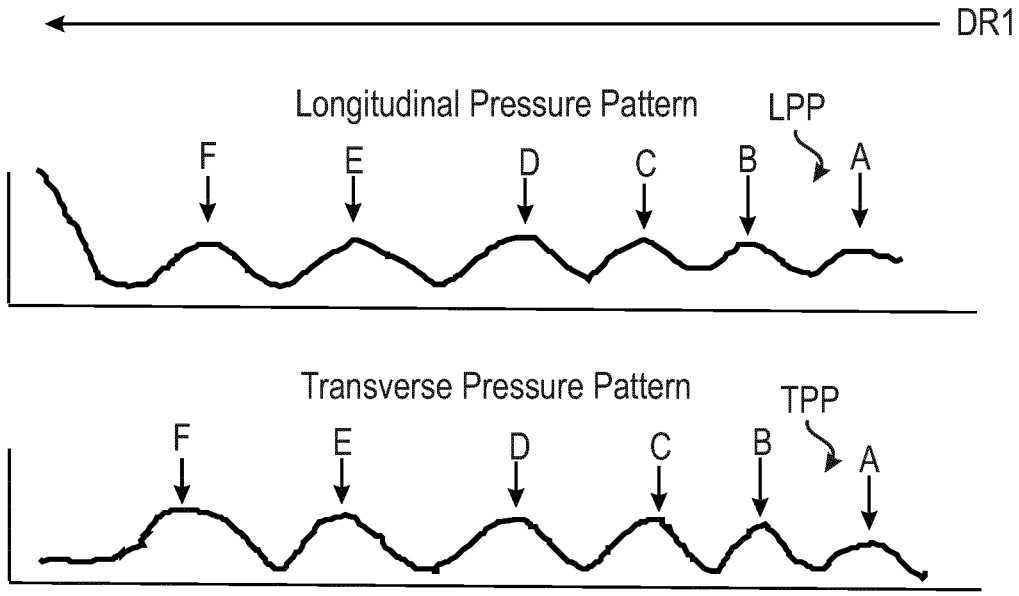
FIG. 5 is an approximate graphical representation of longitudinal and transverse pressure patterns measured with the pressure sensor of FIG. 4A, in accordance with aspects of the present disclosure.

The top graph of FIG. 5 shows an example measured longitudinal pressure pattern LPP generated when the user pushes the brush head in direction DR1 from the front of the mouth toward the back of the mouth in the quadrant shown in FIG. 4A. The pressure sensor 42 generates the longitudinal pressure pattern LPP. In the example shown in FIG. 4A, as a user pushes brush head 14 in direction DR1, pressure sensor 42 generates the longitudinal pressure pattern LPP shown in the top graph of FIG. 5. The longitudinal pressure pattern LPP is positive above the abscissa (e.g., the horizontal axis) when the user pushes the brush head 14 in direction DR1. Pressure peak A in FIG. 5 corresponds with the tooth 50A in FIG. 4A, pressure peak B in FIG. 5 corresponds with the tooth 50B in FIG. 4A, pressure peak C corresponds with the tooth 50C in FIG. 4A, pressure peak D corresponds with the tooth 50D in FIG. 4A, pressure peak E corresponds with the tooth 50E in FIG. 4A, pressure peak E corresponds with the tooth 50E in FIG. 4A, and pressure peak F corresponds with the tooth 50F in FIG. 4A.

The bottom graph of FIG. 5 shows an example measured transverse pressure pattern TPP generated when the user pushes brush head 14 in direction DR1 toward the back of the mouth. The pressure sensor 42 generates the transverse pressure pattern TPP. In the example shown in FIG. 4A, as a user pushes brush head 14 in direction DR1, pressure sensor 42 generates the transverse pressure pattern TPP shown in the bottom graph of FIG. 5. The transverse pressure pattern TPP is positive above the abscissa like the longitudinal pressure pattern LPP above. Each pressure peak A, B, C, D, E, F, corresponds to the teeth shown in FIG. 4A (50A, 50B, 50C, 50D, 50E, and 50F, respectively). The top and bottom graphs of FIG. 5 are substantially similar but the transverse pressure pattern TPP does not exhibit a high peak at the back of the mouth for the outer-most sides of the teeth after F. Most transverse pressure is generated when the user brushes the outside parts of the molars (i.e., when the brush head is between the teeth and the inside of the cheeks). In these cases, there is a friction force on both sides of the brush head. When the brush head is cleaning the inner side of the teeth, the transverse pressure is less since there is only friction on one side from the teeth. If the user lifts the brush from the teeth on the inner side of the mouth, moves the brush through the air and places it back, the pressure sensor will momentarily not be able to add additional information, but can recover once the brush head is in contact again with the teeth. In embodiments, assuming that the friction force pattern is the same everywhere or among a same type of position in the mouth, the integral of the amount of "pressure changes" can provide a measure of how much the brush head has moved alongside the teeth or a distance. Such a function can be described by the following formula:

$$\text{distance} \sim \int_{t=t_0}^{t=t_1} \text{sign}\,(P(t)) \left| \frac{dP(t)}{dt} \right| dt$$

The sign function indicates the direction of the relative movement of the brush with the mouth.

However, in practice the friction (pattern) and, hence experienced pressure, is different on each place (on each tooth, tooth transition etc.) This actually helps in localization since the change in pressure or the friction now directly provides a predictive value of where (e.g., which tooth) the brush head is located.

Figure 6:
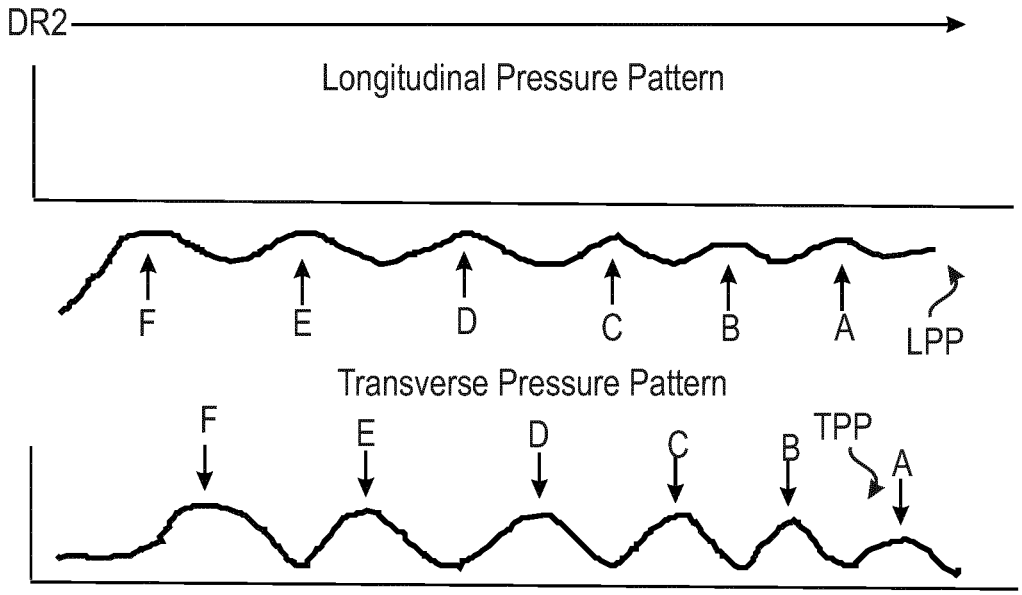
FIG. 6 is an approximate graphical representation of longitudinal and transverse pressure patterns measured with the pressure sensor of FIG. 4A, in accordance with aspects of the present disclosure.

The top graph of FIG. 6 shows an example measured longitudinal pressure pattern LPP generated when the user pulls brush head 14 in direction DR2, opposite direction DR1, from the back of the mouth toward the front of the mouth. In the example shown in FIG. 4A, as a user pushes brush head 14 in direction DR2, pressure sensor 42 generates the longitudinal pressure pattern LPP shown in the top graph of FIG. 6. The longitudinal pressure pattern LPP is negative below the abscissa since the brush head 14 is being pulled rather than pushed. Each pressure peak A, B, C, D, E, F, corresponds to the teeth shown in FIG. 4A (50A, 50B, 50C, 50D, 50E, and 50F, respectively).

The bottom graph of FIG. 6 shows an example measured transverse pressure pattern TPP generated when the user pulls brush head 14 in direction DR2 from the back of the mouth toward the front of the mouth. Even though the brush head is being moved in the opposite direction, the transverse pressure pattern TPP is still positive above the abscissa since the transverse pressure component only refers to the pressure exerted by the teeth. In other words, the resistive forces exerted by the teeth on the brush head generate the same pressure peak values having the same magnitude regardless of direction (e.g., direction DR1 and/or direction DR2).

Figure 7A:
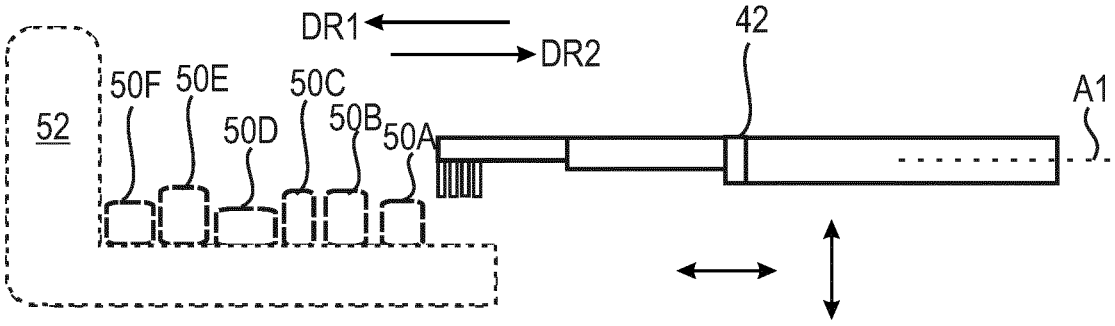
FIG. 7A is a schematic representation of an oral care device with teeth of a quadrant of a user's mouth, in accordance with aspects of the present disclosure.
Figure 7B:
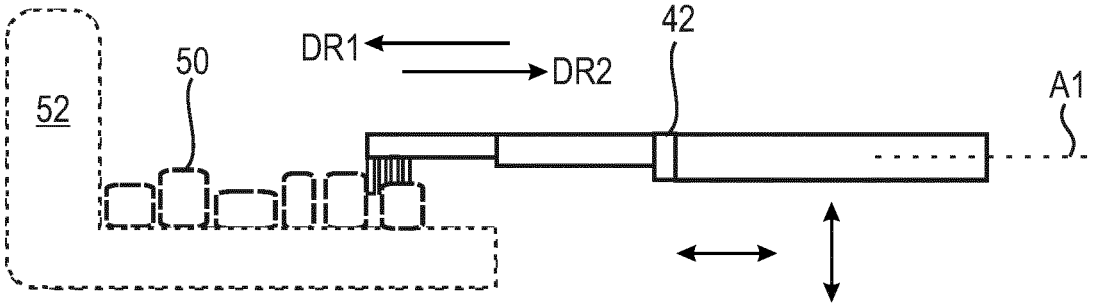
FIG. 7B is a schematic representation of the oral care device of FIG. 7A moved to a position closer to the back of the user's mouth, in accordance with aspects of the present disclosure.
Figure 7C:
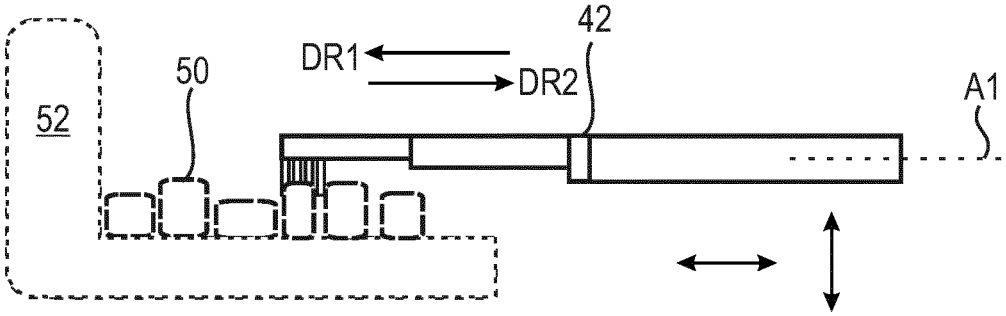
FIG. 7C is a schematic representation of the oral care device of FIG. 7A moved to another position closer to the back of the user's mouth, in accordance with aspects of the present disclosure.

In the embodiment of the brush head 14 shown in FIGS. 4A, 4B, and 4C, the bristles 18 can cover more than one tooth at the same time. For example, as shown in FIG. 4C, the bristles 18 contact teeth 50A, 50B, and 50C at the same time. In contrast, as shown in the embodiment of a brush head shown in FIGS. 7A, 7B, and 7C, the bristles 18 move from tooth to tooth since the bristles 18 extend from a smaller portion of brush head 16 than the bristles shown in FIGS. 4A, 4B, and 4C. It should be appreciated that the brush head of FIGS. 7A, 7B, and 7C generates different pressure patterns than the brush head shown in FIGS. 4A, 4B, and 4C due to the different brush head configuration. Brush heads that move from tooth to tooth generate pressure patterns in real time that correspond to individual teeth. In contrast, brush heads that cover two or more teeth at the same time generate pressure patterns in real time that correspond to two or more teeth. In either scenario, pressure patterns can be mapped to positions. The mapping of the pressure patterns to positions for the embodiment shown in FIGS. 4A, 4B, and 4C is more complex but advantageously the mappings are different for each place in the mouth and this helps further in localizing the brush head.

As described herein, pressure sensor 42 communicates the longitudinal pressure patterns LPP and the transverse pressure patterns TPP in real-time to the controller 30 and the oral care device 10 can match the patterns LPP and TPP to previously stored patterns for each quadrant of the user's mouth. For example, controller 30 can be programmed and/or configured to effectuate: (i) analyzing data from inertial motion sensor 28 and pressure sensor 42; and (ii) estimating, based on the data, a position of the oral care device within the user's mouth irrespective of movement of the user's head. In embodiments, once the controller derives in which quadrant the user is brushing the controller can estimate a position at which the device is located within the quadrant by counting the peaks in the pressure signal. Such approximations provide improved localization even if the user moves during the brushing routine.

As described herein, Applicant has appreciated and recognized that it would be beneficial to determine a location of a brush head during a brushing session by counting a number of peaks in a pressure signal from a pressure sensor combined with a detection of a particular quadrant of the mouth. However, each mouth of each person is different. For example, some users can have teeth arranged in a peculiar manner or have teeth missing altogether. Thus, in embodiments the controller 30 is calibrated with sensor data so the controller 30 can learn user-specific pressure patterns and anchor points.

Figure 8:
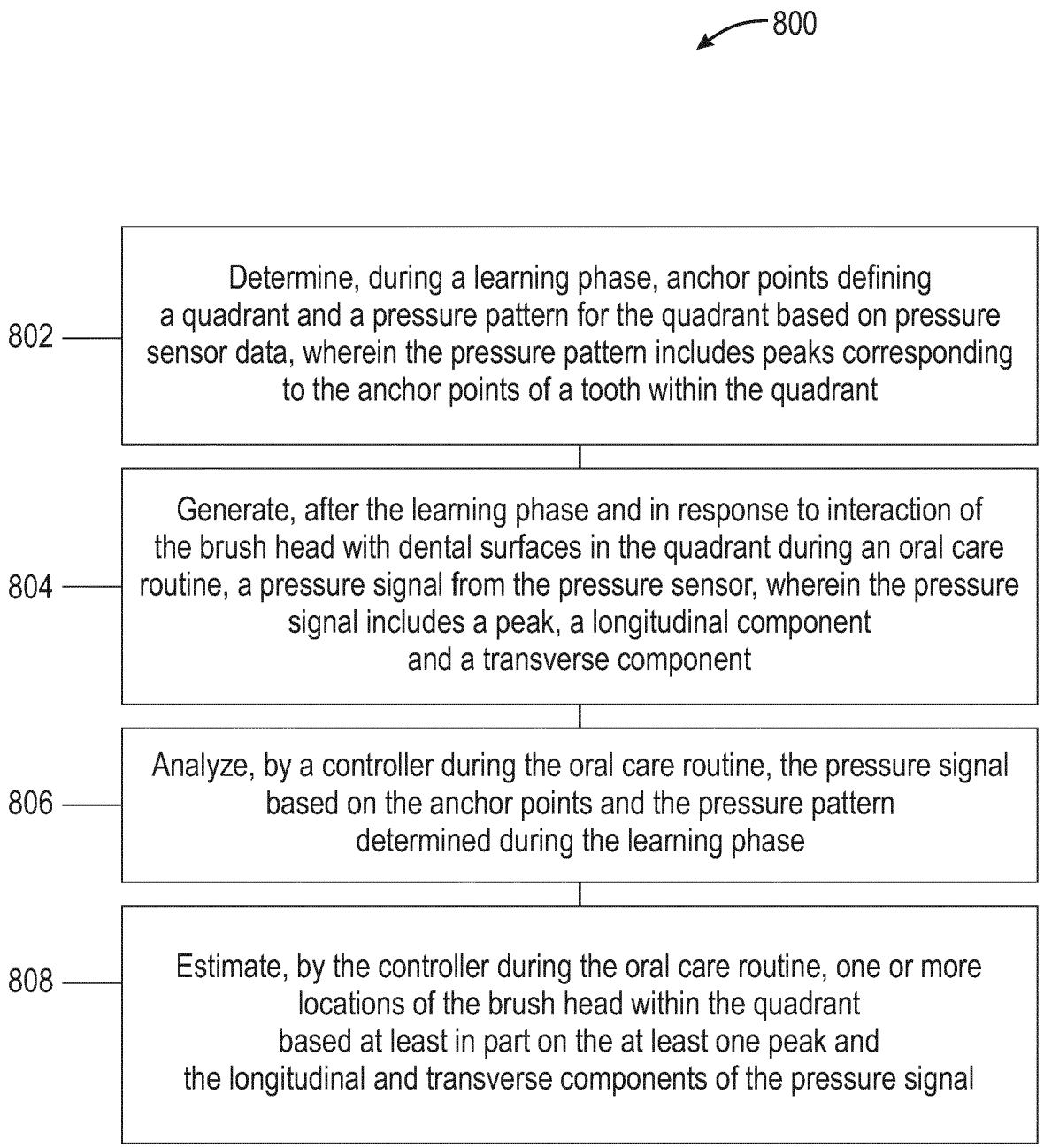
FIG. 8 is a flowchart of a method for determining a location of a brush head within a user's mouth during an oral care routine, in accordance with aspects of the present disclosure.

Referring to FIG. 8, in one embodiment, is a flowchart of a method 800 for determining a location of a brush head of an oral care device within a user's mouth during an oral care routine. At the outset, an oral care device 10 is provided. The oral care device 10 can be any of the embodiments described or otherwise envisioned herein. At step 802 of the method, the oral care device 10 is calibrated. The calibration can comprise, for example, defining anchor points of quadrants and/or transitions between quadrants. Anchor points are locations that are known precisely or with a high probability. For example, when cleaning the outside of the teeth at the back of the mouth, the pressure sensor 42 experiences a very high pressure peak. Thus, when this high pressure peak is detected, it can be determined that the brush head is located at the back of the mouth. Additionally, when a user starts brushing a new quadrant, the user typically sets the brush head on a specific starting place depending on the quadrant and depending on left or right handedness. In embodiments, the calibration is performed by the user but it can also be performed by the factory prior to reaching the user. For example, the user can use the device during a guided brushing session and system 300 can store instantaneous sensor data from sensors 28 and 42. This way, the system 300 can learn specific unique pressure patterns and orientations from the sensors for particular locations within the user's mouth.

In embodiments, an algorithm within the controller 30 learns the pressure patterns for the different quadrants of the user. In embodiments, a pressure map is built for each user of device 10 and in subsequent brushing sessions this pressure map is used to locate the measured pressure pattern. While this pressure map contains features that are unique to the individual user, this pressure map can also contain commonalities between users. The controller 30 can locate a measured pressure pattern within a pressure map based on the following equation:

$$\mathrm{Pos}(t)=\mathrm{Localisation}(P(t-N), P(t+1), \ldots, P(t-1), P(t), \mathrm{PressureMap})$$

where the term "Pos(t)" refers to a position at a timestamp;

measured pressure on time t equals $P(t)=P_{longitudinal}(t), P_{transversal}(t)$; and pressure pattern equals $P(t-N), P(t-N+1), \ldots, P(t-1), P(t)$.

Determining the localization function above can involve a neural network and the following steps. In step 1 of the method of determining the localization function, training data from brushing sessions from one hundred users can be gathered, for example. In step 2, a neural network can be trained using the training data to map measured pressure patterns to toothbrush positions. Typical network architectures include long-short term memory (LSTM) artificial recurrent neural network architectures, convolutional neural networks (CNN), and bidirectional encoder representations from transformers (BERT). In step 3, for each new user the calibration phase data can be used to fine-tune the neural network to that specific person.

Instead of using a neural network, determining the localization function above can involve a simultaneous localization and mapping (SLAM)-based algorithm. In an embodiment, a Bayesian filter can be used to determine the belief distribution of the brush head at a certain position x: $\mathrm{bel}(x_t)=P(x_t|z_{o:t}, u_{0:t})$. This is the probability distribution over the position x on time stamp t based on all previous sensor measurements z between time 0 and time t and previous actions u between time 0 and time t. In case of robotics or autonomous driving, the actions u are typically the driving controls sent to the wheels of the device and the measurements are typically laser range finders, ultrasound sensors, or camera sensors. In the case of localizing the head of a toothbrush in the mouth of a user, the pressure measurements $p_t$ are the sensor measurements and the accelerometer measurements signal $a_t$ can be regarded as a proxy for the control actions (movements) from the user. So this means that we can fill in $z_{o:t}$ with $p_{o:t}$ and $u_{o:t}$ with $a_{o:t}$. The result is: $\mathrm{bel}(x_t)=P(x_t|p_{o:t}, a_{0:t})$.

A common way to determine the $\mathrm{bel}(x_t)$ distribution is through a Bayesian Filter algorithm. The Bayesian filter algorithm executes the following steps for every time stamp t:

In step 1: $\mathrm{bel_approx}(x_t)=\int P(x_t|\mathrm{accel}_t, x_{t-1}, m)\mathrm{bel}(x_{t-1})\,dx_{t-1}$.

In step 2: $\mathrm{bel}(x_t)=\eta P(p_t|x_t, m)\ \mathrm{bel_approx}(x_t)$.

The first step (also known as a "control update") provides a first estimation or prediction of the new position (probability distribution) based on the measured accelerometer data and the previous position belief (probability distribution).

The second step is the "measurement update" which fine-tunes the first estimation or prediction by increasing the estimated probability of those locations that correspond well with the measured pressure and vice versa decreasing the belief in those locations that do not well fit the measured pressure data.

Now to use this algorithm, we still need to determine the prediction of the probability distribution P of the brush being at location $x_t$ when the previous location was at $x_{t-1}$ and the brush has measured an acceleration $a_t$ at time t. The prediction can be expressed as follows: $P(x_t|a_t, x_{t-1})$. This probability distribution can be approximately determined by either (or a combination of) physical simulation and/or physical measurements on a set of representative brushing sessions. After that, this probability function can be further fine-tuned and personalized by a first guided brushing session during first usage of the toothbrush.

To use this algorithm, we also still need to determine the probability distribution P of measuring pressure $p_t$ at a certain location $x_t$ at time stamp t. The probability distribution can be expressed as follows: $P(p_t|x_t)$. This function can be regarded as a map; we need to know at which places in the mouth, the brush head experiences which pressures. This mapping is slightly different for each person and can be done when a new user buys a new toothbrush (and might need to be repeated every time a major reconfiguration of a person's teeth happens, for example, when a user loses one or more teeth or receives new teeth).

The above steps hold even if the map is not known at the start. However, in the case of tooth brushing we can assume that the map of the mouth is known by performing a guided first brushing session. If the map m is already known, the above Bayesian filter simplifies to what is known Markov localization. The Markov localization algorithm can be expressed as follows: $bel(x_t)=P(x_t|x_{0:t-1}, p_{1:t-1}, a_{1:t-1}, m)$.

The following is executed in step 1 of the Markov localization algorithm for every time stamp t: $bel_app(x_t)=\int P(x_t|a_t, x_{t-1}, m)bel(x_{t-1})dx_{t-1}$.

The following is executed in step 2 of the Markov localization algorithm for every time stamp t: $bel(x_t)=\eta p(p_t|x_t, m)\ bel_app(x_t)$.

According to an embodiment, the oral cleaning device develops a calibration data set over one or more brushing sessions by comparing data between those sessions instead of requiring the user to perform a guided brushing session. A self-learning method could also be utilized to supplement, amend, or otherwise adjust a user calibration. In an embodiment, brushing patterns and pressure patterns can be used to train an algorithm on a large set of data from various people. Such data can be uploaded to a backend. Alternatively, the algorithm can be trained via a federated learning approach, where the data does not need to be uploaded but only the changes to the algorithm.

At step 804 of the method after the learning phase, the oral care device 10 is positioned within the mouth during an oral care routine and the brush head interacts with the dental surfaces. The forces exerted on the brush head are communicated to the pressure sensor 42, and a pressure signal is generated by the pressure sensor 42 that measures the forces in a quantitative way. The pressure signal includes at least one peak (e.g., A, B, C, D, E, and F) that corresponds to at least one tooth in a defined quadrant. The pressure signal also includes a longitudinal component indicating a direction the brush head is moving and a transverse component indicating an amount of pressure exerted on the pressure sensor by the plurality of dental surfaces. As discussed above, if the longitudinal pressure pattern is positive, then the user is moving the brush head in direction DR1. If the longitudinal pressure pattern is negative, then the user is moving the brush head in direction DR2.

The pressure signal from the pressure sensor 42 is used in combination with a determination of which quadrant the device is located during an oral care routine. In embodiments, the controller 30 can derive whether the brush head is brushing the top or bottom teeth based on the angle of the brush head. For example, if the brush head is at a downward angle (e.g., 45 degrees), it can be derived that the brush head is brushing the bottom teeth. If the brush head is at an upward angle (e.g., 45 degrees), it can be derived that the brush head is brushing the top teeth. The controller 30 can determine the angle of the brush head based on measurements obtained from an accelerometer or a gyroscopic sensor within or coupled to the device 10.

Once it is determined whether the brush head is brushing the top or bottom teeth, then the controller 30 can derive which quadrant the user is brushing. For example, if the brush head points to the right, the brush head is either on the outer side of the left teeth or on the inner side of the right teeth. A right-handed person always brushes the right side of the teeth with the right side of the brush (from the brush perspective) down and the left side of the teeth with the left side down. For the front teeth, the right side is the front side and the left side is the back side. For a left-handed person, it is the opposite. Whether the brush head is on the left side of the left teeth or of the right teeth, or the front side of the front teeth is not straightforward to determine from the sensor data from a single timestamp. Some time span has to be taken into account. Thus, rules can be based on heuristic rules. Alternatively, the algorithms discussed herein can be used to take a time sequence of positions into account.

At step 806 of the method, the controller 30 analyzes the pressure signal based on the anchor points and pressure patterns stored during the learning phase. In an embodiment, the controller 30 compares the pressure signal with the pressure patterns for the particular quadrant where the brush head is located.

At step 808 of the method, the controller 30 estimates one or more locations of the brush head within the defined quadrant based at least in part on the at least one peak and the longitudinal and transverse components of the pressure signal. The controller 30 further uses the determination of which quadrant the device is located to determine the position within the quadrant.

In an embodiment, an algorithm of the controller 30 is carried out as follows. For each timestamp t: (i) determine a quadrant or a whether there has been a quadrant change as discussed above; (ii) determine if at least one new tooth (peak) was passed and make new estimate of position (output is real time position estimation); (iii) detect if current position is anchor point (e.g., back of mouth or new quadrant started); (iv) if anchor point was detected: set current position to anchor position (output is real time position) and if the estimated position does not equal the anchor position (i.e., the estimated position was erroneous) correct the previous real time position to match previous and current reference points.

The real time position estimate of current position is based on a previous anchor point detected and estimations based on the pressure signal since measuring the last anchor point.

The non-real time detection (correction) of passed positions refers to each time a new anchor point is detected. The controller 30 checks whether the previous (real time) estimated positions should be modified or adapted (e.g., when counting the peaks some cumulative errors can occur, especially if the user does a lot of front and back movements with their oral care device 10. These cumulative errors can be corrected after a new anchor point is detected.

The algorithm expressed above can be represented with the following formulas:

$$\text{Cur_pos}(t)=\text{pos_last_anch_point}(t)+\text{num_of_transitions_detected_since_last_anchor_point}(t)$$

where the current position at a timestamp is equal to the position of the last anchor point at the timestamp plus the number of teeth transitions detected since the last anchor point at the timestamp. Position is an integer number representing a number of a tooth as mapped during the learning phase.

$$\text{Cur_pos}(t) = \text{pos_last_anch_point}(t) + \int_{t_{lap}}^{t} TTD(t)dt$$

where "$t_{lap}$" is the timestamp of last anchor point; and

"TTD(t)" is a "Tooth Transition Detection" function which should be manually constructed or learned from data.

The value of TTD(t) is equal to 1 if a tooth transition was detected at time t while moving forward towards back of mouth (pressure detected is positive). The value of TTD(t) is equal to 0 if no tooth transition was detected at time t. The value of TTD(t) is equal to −1 if a tooth transition was detected at time t while moving from the back of the mouth towards the outside of the mouth.

Using the anchor points and pressure patterns as a frame of reference, the device can deduce and therefore track the location of the oral care device as the user moves it throughout the mouth, adopting new orientations and locations.

The system or device can provide feedback to the user regarding the estimated position of the brush head within the user's mouth during the oral care routine. This may be in substantially real time, meaning as soon as the information is generated and available. The feedback may include information about the orientation of the brush head, whether the orientation is proper or improper, brushing time, coverage, brushing efficacy, and/or other information. According to an embodiment, the feedback may include the amount of time spent brushing specific segments in the user's mouth. In an even more advanced feedback mechanism, the user could receive feedback about individual teeth within a region. The system can communicate information to the user about which regions were adequately brushed and which regions were not adequately brushed. The feedback may be provided via user interface 40, and can be a display, report, or even a single value, among other types of feedback.

The system can provide real-time feedback data to a user or to a remote system. For example, the system can transmit real-time feedback data to a computer via a wired or wireless network connection. As another example, the system can transmit stored feedback data to a computer via a wired or wireless network connection. In addition to these feedback mechanisms, many other mechanisms are possible. For example, the feedback can combine brushing time and efficacy into a display, report, or even a single value, among other types of feedback.

In an embodiment, the system or device provides feedback to the user regarding an entire cleaning session. The system collects information about motion and orientation of the device 10 during the cleaning session, and collates that information into feedback.

In addition to or in lieu of the above described embodiments including the pressure sensor 42, the sensor data from the inertial motion sensors 28 within oral care device 10 can be combined with sensor data from accelerometers and potentially gyroscopes in smart head worn devices to distinguish the head movement from movement of oral care device 10. As shown in the embodiment of FIG. 9, additional sensor data from a smart wearable device can be used to increase the accuracy of brush head localization and orientation in the mouth of the user.

With the current availability and affordability of completely wireless earphones (aka earbuds), like e.g. Apple's air pods, and smart glasses, people are increasingly wearing wireless smart earphones and/or glasses during all kinds of everyday activities. This is made possible since no wires are hindering activities anymore, and the devices are becoming more water resistant. For example, wearing (one or two) phone connected wireless in-ear headphones to listen to music, podcasts, vlogs, series etc. is especially done during activities and chores, like e.g., brushing teeth. The accelerometer data from one or more both earbuds can be combined with the accelerometer data from the inertial motion sensor 28 in the body portion 12 of device 10 to detect how the head and the device 10 are moving with respect to each other.

Figure 9:
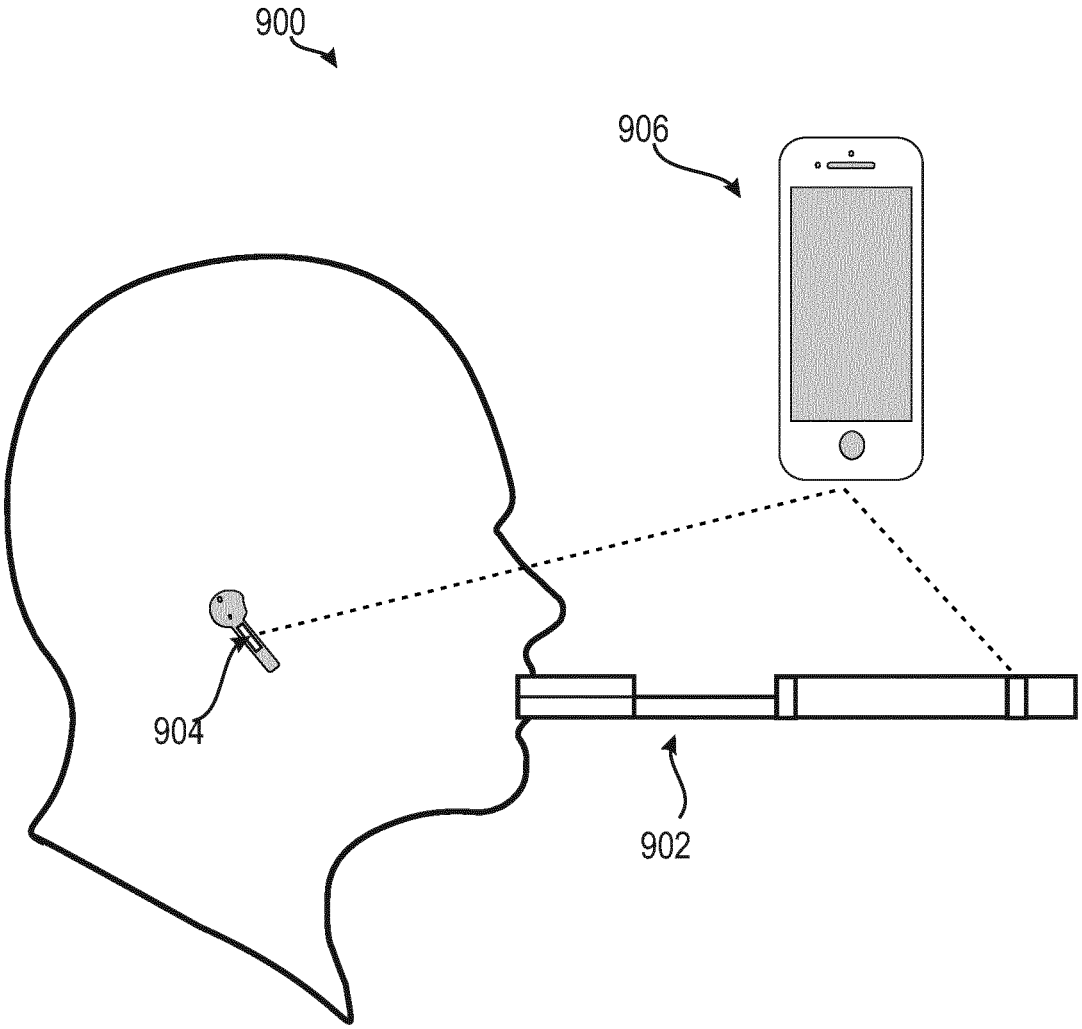
FIG. 9 is a schematic representation of an oral care system, in accordance with aspects of the present disclosure.
Figure 10:
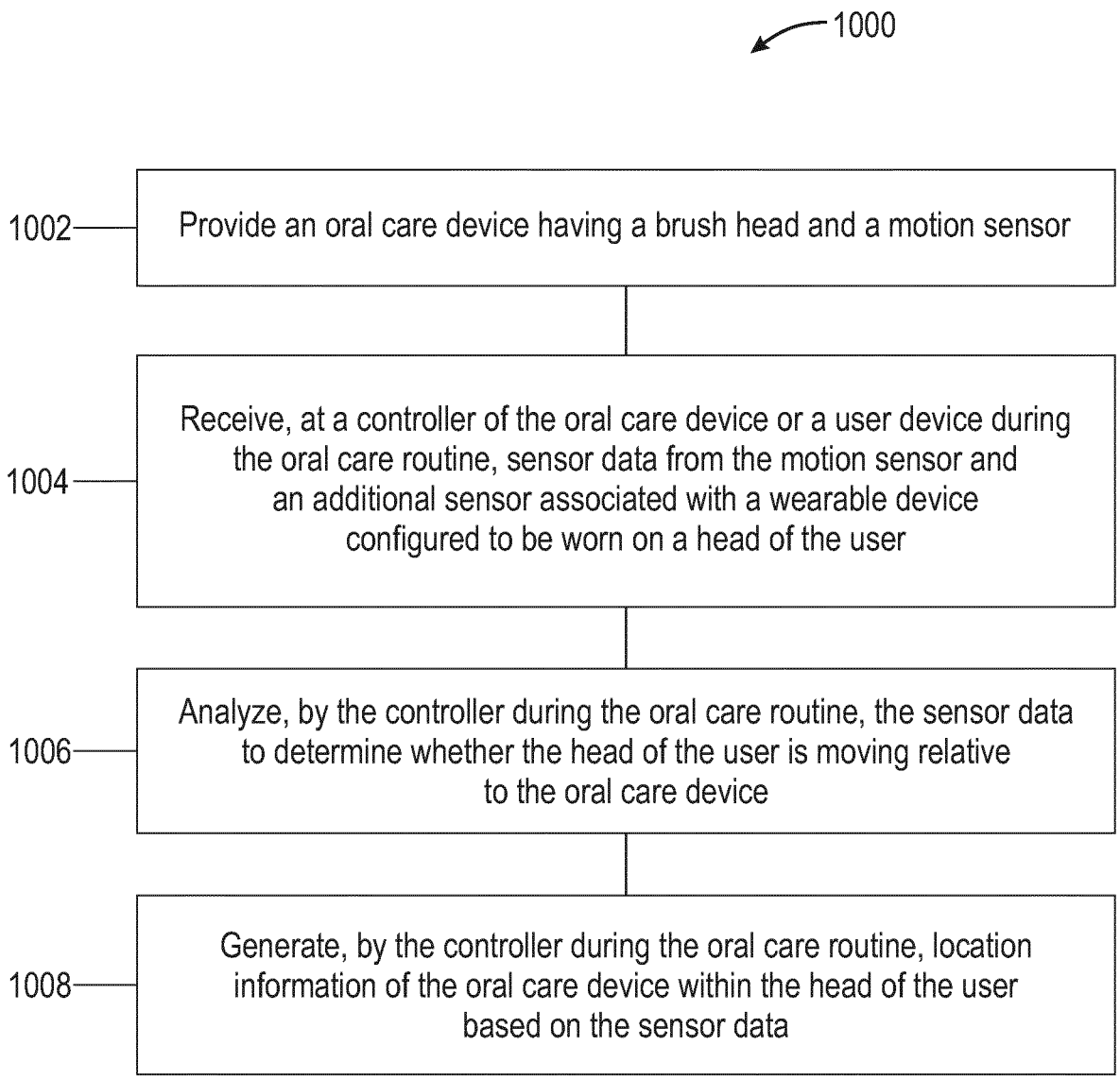
FIG. 10 is a flowchart of a method for determining a location of a brush head within a user's mouth during an oral care routine, in accordance with aspects of the present disclosure.

Referring to FIG. 9, system 900 includes an oral care device 902 including an accelerometer (e.g., sensor 28), a wearable device 904 having an additional accelerometer, and a user device 906 configured to output data to the user regarding feedback for a brushing session. Oral care device 902 can be any of the embodiments described or otherwise envisioned herein. The wearable device 904 can be any suitable device capable of detecting movement of the user's head. Sensor data from oral care device 902 and wearable device 904 can be analyzed at controller within oral care device 902 or some controller within user device 904.

Either controller can detect if the user's head and device 902 are moving in unison by determining that both accelerometer signals exhibit a similar accelerometer signal trace. Similar accelerometer signals from both sensors means that the device 902 is staying on the same spot in the mouth. Either controller can detect if the user's head is still by receiving or detecting a flat earbud accelerometer signal. If the user's head is not moving, then all movement detected by the accelerometer of device 902 is related to the device 902 changing its position in the mouth. Typically, there is movement from the user's head and the device 902 related to the user's head. In this case, the head movement as detected by the accelerometer signal from the wearable device 904 (e.g., earbuds) is subtracted from the path of the brush head. Sudden head movements can also occur when the user transitions during the brushing session from one mouth segment to another, to facilitate "easy brush access" to this new segment. The head movements during these transition moments indicating new segment access can also be detected by the earbud accelerometers.

In another embodiment, in-mouth vibrations resulting from the electrical brush touching the teeth or molars can be picked up by the accelerometers in the wearable device 904. This information can be used to distinguish between touching-teeth moments and touching-nothing moments during the brushing session. Furthermore, it can be used to determine whether the brush is positioned in the left or right cheek. For example, when the brush in in the left cheek, it is closer to left ear, and thus a larger vibration signal can be detected in left ear than in the right ear.

In a further embodiment, sounds from the electrical brush can also be detected by one or more microphones within wearable device 904. The sound differences picked up from the device 902 between left and right earbud microphones can provide information on relative position of the brush head to both ears. In an embodiment, a single microphone in a left or right earbud can provide information on relative position of the brush head to both ears by picking up sound differences from the device 902.

In an embodiment, the sounds or vibrations coming from the brush head in the mouth via bones are different when touching teeth than when touching gums. This could then also be detected by either the in-ear accelerometers or microphones and used for coaching feedback.

In a further embodiment, in case the user is wearing a smartwatch on his/her wrist that is also being used during brushing, comparing data from the localization and orientation sensors in the watch with data from the sensors in the brush can be used to infer the position and orientation of the handle with respect to the hand that holds it.

An accelerometer signal can be considered like an audio signal and be sent over by Bluetooth, Wi-Fi etc. In an embodiment, both data of the one or more earbud accelerometers and the toothbrush accelerometer are sent via Bluetooth (or Wi-Fi etc.) to user device 906 (e.g. a smart phone) for further processing and localization determination. On the user device 906 both signals can be combined to calculate a 3D relative location of the device 902.

In a further embodiment, wearable device 904 is embodied as smart glasses and contain one or more accelerometers to provide the sensor data to distinguish the head movement from movement of oral care device 902. In embodiments, the smart glasses could also include a camera which can be used to generate a video stream. The video stream can be analyzed to estimate head movement.

In still further embodiments, the wearable device 904 can also play an active role in guiding the brushing routine. In embodiments where the wearable device includes one or more earbuds, short audio cues can be superimposed on audio signals being transmitted from the device (e.g., music or a podcast) that is being listened to. The audio cues can indicate the brushing quality, e.g., too much pressure or wrong angle of oral care device 10, 902 by degrading the audio signal. In embodiments where the wearable device includes smart glasses, visual cues can be provided to the user indicating which tooth he/she is brushing or which tooth he/she should be brushing next.

According to an embodiment, the systems and methods include an oral care device, one or more sensors having at least an inertial motion sensor and a pressure sensor, and an additional sensor that distinguish head movement from device movement. The systems and methods can analyze motion sensor data and pressure sensor data in order to distinguish head movement from device movement. The system can also combine motion sensor data and additional sensor data from a sensor of a wearable device in order to distinguish head movement from device movement. Distinguishing head movement from device movement enables increased accuracy of brush head localization and orientation in the mouth of the user and, thus, improved tracking mechanisms. The tracking mechanisms can be utilized to provide feedback to the user regarding how they brush during an oral care routine.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

What is claimed is:

1. A method for determining a location of a brush head of an oral care device within a user's mouth during an oral care routine, the method comprising:

determining, during a learning phase, first and second anchor points defining a quadrant of the mouth of the user and a pressure pattern for the defined quadrant based on pressure sensor data from a pressure sensor within the oral care device, wherein the pressure pattern comprises at least two peaks in the pressure sensor data, the at least two peaks corresponding to the first or second anchor points or a tooth within the defined quadrant of the mouth of the user;

generating, after the learning phase and in response to interaction of the brush head with a plurality of dental surfaces in the defined quadrant during the oral care routine, a pressure signal from the pressure sensor, wherein the pressure signal comprises at least one peak, a longitudinal component indicating a direction the brush head is moving, and a transverse component indicating an amount of pressure exerted on the pressure sensor by the plurality of dental surfaces;

analyzing, by a controller during the oral care routine, the pressure signal based on the anchor points and the pressure pattern determined during the learning phase; and estimating, by the controller during the oral care routine, one or more locations of the brush head within the defined quadrant based at least in part on the at least one peak and the longitudinal and transverse components of the pressure signal.

2. The method of claim 1, wherein the step of estimating the location of the brush head comprises:

detecting the brush head is located within the defined quadrant during the oral care routine;

counting, by the controller, at least one peak in the pressure signal; and outputting, by the controller, a first estimated location of the brush head in real time based on the at least one peak counted in the pressure signal.

3. The method of claim 2, further comprising the steps of:

detecting the brush head is located at the first or second anchor point of the defined quadrant during the oral care routine; and outputting, by the controller, a second estimated location of the brush head in real time, wherein the second estimated location is the first or second anchor point of the defined quadrant.

4. The method of claim 3, further comprising the steps of:

determining that the first real time estimated location is not equal to the second real time estimated location; and modifying, by the controller, the first real time estimated location based at least in part on the second estimated location.

5. The method of claim 1, further comprising the steps of:

obtaining motion sensor data from an inertial motion sensor of the oral care device and additional motion sensor data from an additional sensor configured to be worn on the user's head as a wearable device;

analyzing the motion sensor data and the additional motion sensor data; and distinguishing, by the controller, movement of the oral care device relative to movement of the user based at least in part on the motion sensor data and the additional motion sensor data.

6. The method of claim 5, further comprising the step of providing feedback to the user regarding the determined movement of the oral care device with respect to movement of the user via the wearable device.

7. The method of claim 5, wherein the additional motion sensor data comprises an accelerometer signal that indicates vibrations resulting from the oral care device contacting the mouth of the user.

8. The method of claim 5, wherein the wearable device further comprises a microphone and the step of distinguishing movement of the oral device relative to movement of the user comprises determining a relative position of the oral care device relative to the microphone.

9. The method of claim 5, wherein the wearable device further comprises a camera and the additional motion sensor data comprises video data from the camera and the step of distinguishing movement of the oral care device relative to movement of the user comprises estimating the movement of the user's head based on analysis of the video data.

10. An oral care device, comprising:

a body portion and a brush head;

a pressure sensor configured to generate pressure sensor data and a pressure signal; and a controller in communication with the pressure sensor;

wherein during a learning phase, the controller is configured to:

determine first and second anchor points defining a quadrant of the mouth of the user and a pressure pattern for the defined quadrant based on the pressure sensor data from the pressure sensor, wherein the pressure pattern comprises at least two peaks, the at least two peaks corresponding to the first or second anchor points or a tooth within the defined quadrant;

wherein after the learning phase and during an oral care routine, the controller is configured to:

analyze the pressure signal from the pressure sensor based on the first and second anchor points and the pressure pattern determined during the learning phase, the pressure signal comprising at least one peak, a longitudinal component indicating a direction the brush head is moving, and a transverse component indicating an amount of pressure exerted on the pressure sensor; and estimate one or more locations of the brush head within the defined quadrant based at least in part on the at least one peak and the longitudinal and transverse components of the pressure signal.

11. The oral care device of claim 10, further comprising:

an inertial motion sensor in communication with the controller, wherein the inertial motion sensor is configured to provide motion sensor data; and an additional motion sensor configured to be worn on the head of the user as a wearable device, wherein the additional motion sensor is in communication with the controller and configured to provide additional motion sensor data;

wherein the controller is configured to analyze the motion sensor data and the additional motion sensor data and distinguish movement of the oral care device relative to movement of the user based at least in part on the motion sensor data and the additional motion sensor data.

12. The oral care device of claim 11, wherein the additional motion sensor data comprises an accelerometer signal that indicates vibrations resulting from the oral care device contacting the mouth of the user.

13. The oral care device of claim 11, wherein the wearable device further comprises a microphone and the controller is configured to determine a position of the oral care device relative to the microphone.

14. The oral care device of claim 11, wherein the wearable device further comprises a camera and the additional motion sensor data comprises video data from the camera and the controller is configured to estimate movement of the head of the user based on an analysis of the video data.

* * * * *